US010349183B2

(12) United States Patent
Billson et al.

(10) Patent No.: US 10,349,183 B2
(45) Date of Patent: Jul. 9, 2019

(54) ELECTROSTATIC TRANSDUCER

(71) Applicant: Warwick Acoustics Limited, Nuneaton (GB)

(72) Inventors: Duncan Billson, Warwickshire (GB); Brian Atkins, Osbaston (GB); Kevin Walsh, Brynhyfryd (GB)

(73) Assignee: Warwick Acoustics Limited, Nuneaton (GB)

( * ) Notice: Subject to any disclaimer, the term of this patent is extended or adjusted under 35 U.S.C. 154(b) by 68 days.

(21) Appl. No.: 15/118,169

(22) PCT Filed: Feb. 11, 2015

(86) PCT No.: PCT/GB2015/050372
§ 371 (c)(1),
(2) Date: Aug. 11, 2016

(87) PCT Pub. No.: WO2015/121638
PCT Pub. Date: Aug. 20, 2015

(65) Prior Publication Data

US 2017/0171668 A1 Jun. 15, 2017

(30) Foreign Application Priority Data

Feb. 11, 2014 (GB) ..... 1402363.4

(51) Int. Cl.
*H04R 19/02* (2006.01)
*H04R 7/14* (2006.01)

(52) U.S. Cl.
CPC ..... *H04R 19/02* (2013.01); *H04R 7/14* (2013.01)

(58) Field of Classification Search
CPC ..... H04R 19/02
See application file for complete search history.

(56) References Cited

U.S. PATENT DOCUMENTS 2,975,243 A 3/1961 Katella
3,895,193 A 7/1975 Bobb
(Continued)

FOREIGN PATENT DOCUMENTS

CA 2195442 2/1996
CN 1333993 A 1/2002
(Continued)

OTHER PUBLICATIONS

International Searching Authority, International Search Report and Written Opinion dated Apr. 30, 2016, issued in connection with International Application No. PCT/GB2015/050372, filed on Feb. 11, 2015, 9 pages.
(Continued)

*Primary Examiner* — Yosef K Laekemariam
(74) *Attorney, Agent, or Firm* — McDonnell Boehnen Hulbert & Berghoff LLP

(57) ABSTRACT

An electrostatic transducer (100) comprises an electrically conductive first member (102) having an array of through apertures (112) and one or more further members (104, 106). The one or more further members (104, 106) include a flexible electrically conductive second member (106) arranged in use to be displaced from an equilibrium position towards the first member (102) by an electrostatic force in response to an electrical potential applied to one or both of the first member (102) and the second member (106). At least one (104) of the one or more further members is resiliently deformable and is arranged in use to exert a resilient biasing force biasing said second member (106) back towards said equilibrium position when displaced therefrom by said electrical potential.

12 Claims, 3 Drawing Sheets

(56) References Cited

U.S. PATENT DOCUMENTS

| | | | | |
|---|---|---|---|---|
| 3,908,098 | A | 9/1975 | Kawakami et al. | |
| 3,935,397 | A | 1/1976 | West | |
| 3,942,029 | A | 3/1976 | Kawakami et al. | |
| 3,992,585 | A | 11/1976 | Turner et al. | |
| 4,533,794 | A | 8/1985 | Beveridge | |
| 5,161,128 | A | 11/1992 | Kenney | |
| 5,471,540 | A | 11/1995 | Maeda | |
| 6,044,160 | A | 3/2000 | Norris | |
| 6,201,874 | B1 | 3/2001 | Croft, III et al. | |
| 6,628,791 | B1 | 9/2003 | Bank et al. | |
| 7,076,070 | B2 | 7/2006 | Pierce et al. | |
| 7,095,864 | B1 | 8/2006 | Billson et al. | |
| 2002/0135272 | A1 | 9/2002 | Toda | |
| 2002/0141606 | A1 | 10/2002 | Schweder et al. | |
| 2003/0123683 | A1 | 7/2003 | Raicevich | |
| 2006/0208609 | A1 | 9/2006 | Heim | |
| 2007/0121970 | A1 | 5/2007 | Miyazaki | |
| 2007/0124620 | A1 | 5/2007 | Miyazaki | |
| 2007/0189559 | A1 | 8/2007 | Haan et al. | |
| 2009/0016551 | A1 | 1/2009 | Chiang et al. | |
| 2009/0041266 | A1 | 2/2009 | Guo et al. | |
| 2009/0304212 | A1 | 12/2009 | Han et al. | |
| 2010/0135519 | A1 | 6/2010 | Werners et al. | |
| 2012/0014543 | A1* | 1/2012 | Chiang | H04R 19/013 381/191 |
| 2012/0237069 | A1 | 9/2012 | Harman | |
| 2013/0044905 | A1 | 2/2013 | Lee et al. | |
| 2014/0232236 | A1* | 8/2014 | Atkins | H04R 7/08 310/300 |
| 2017/0171669 | A1 | 6/2017 | Billson et al. | |

FOREIGN PATENT DOCUMENTS

| | | | |
|---|---|---|---|
| CN | 101256900 | A | 9/2008 |
| CN | 101346015 | A | 1/2009 |
| CN | 101651915 | A | 2/2010 |
| CN | 2016/57310 | | 11/2010 |
| CN | 201657310 | | 11/2010 |
| CN | 102355619 | A | 2/2012 |
| EP | 2043386 | | 4/2009 |
| EP | 2312868 | | 4/2011 |
| GB | 228176 | | 7/1926 |
| GB | 2413027 | | 10/2005 |
| GB | 2490931 | | 11/2012 |
| GB | 2490931 | A | 11/2012 |
| JP | 60046196 | | 3/1985 |
| JP | 60-157399 | A | 8/1985 |
| JP | 2007-067483 | A | 3/2007 |
| JP | 2008-022501 | A | 1/2008 |
| JP | 2008-085507 | A | 4/2008 |
| JP | 2008-172696 | A | 7/2008 |
| JP | 2009-038637 | A | 2/2009 |
| JP | 2009100438 | | 5/2009 |
| JP | 2009153056 | | 7/2009 |
| JP | 2009284397 | | 12/2009 |
| JP | 2009296125 | | 12/2009 |
| JP | 2012-028900 | A | 2/2012 |
| JP | 2013-058889 | A | 3/2013 |
| WO | 1993/01691 | | 1/1993 |
| WO | 1996/03806 | | 2/1996 |
| WO | 1998/35529 | | 8/1998 |
| WO | 2000/35246 | | 6/2000 |
| WO | 2001073861 | A1 | 10/2001 |
| WO | 20001073861 | A1 | 10/2001 |
| WO | 2002/19764 | | 3/2002 |
| WO | 2007/077438 | | 7/2007 |
| WO | 2012/156753 | A1 | 11/2012 |

OTHER PUBLICATIONS

International Searching Authority, International Search Report and Written Opinion dated Apr. 30, 2016, issued in connection with International Application No. PCT/GB2015/050375, filed on Feb. 11, 2015, 11 pages.

UK Intellectual Property Office, Search Report dated Apr. 27, 2016, issued in connection with Application No. GB1402362.6, 3 pages.

UK Intellectual Property Office, Search Report dated Apr. 30, 2016, issued in connection with Application No. GB1402363.4, 4 pages.

Chinese Office Action dated Aug. 29, 2018, for Chinese Patent Application No. 201580019334.6, pp. 1-7.

Japanese Office Action dated Jan. 29, 2019 for Japanese Patent Application No. 2016-551231, pp. 1-5.

* cited by examiner

ELECTROSTATIC TRANSDUCER

CROSS-REFERENCE

This application is a section 371 of International application no. PCT/GB2015/050372, filed Feb. 11, 2015 which claims priority from GB 1402363.4, filed Feb. 11, 2014, which is incorporated by reference in its entirety.

FIELD

This invention relates to an electrostatic transducer and is particularly but not exclusively concerned with a loudspeaker suitable for reproducing audio signals.

BACKGROUND

A traditional electrostatic loudspeaker comprises a conductive membrane disposed between two perforated conductive backplates to form a capacitor. A DC bias is applied to the membrane and an AC signal voltage is applied to the two backplates. Voltages of hundreds or even thousands of volts may be required. The signals cause an electrostatic force to be exerted on the charged membrane, which moves to drive the air on either side of it.

In U.S. Pat. No. 7,095,864, there is disclosed an electrostatic loudspeaker comprising a multilayer panel. An electrically insulating layer is sandwiched between two electrically conducting outer layers. The insulating layer has circular pits on one of its sides. It is said that when a DC bias is applied across the two conducting layers, portions of one of the layers are drawn onto the insulating layer to form small drumskins across the pits. When an AC signal is applied, the drumskins resonate, and parts of that conducting layer vibrate to produce the required sound.

In WO 2007/077438 there is disclosed an further type of electrostatic loudspeaker comprising a multilayer panel. An electrically insulating layer is sandwiched between two electrically conducting outer layers. In this arrangement, one of the outer conducting layers is perforated and, for example, may be a woven wire mesh providing apertures with a size of typically 0.11 mm.

In US 2009/0304212 there is disclosed an electrostatic loudspeaker comprising a conductive backplate provided with an array of vent holes and an array of spacers. Over this is positioned a membrane comprising a dielectric and a conductive film. The space between the backplate and the membrane is about 0.1 mm and it is said that a low voltage supplied to the conductive backplate and the conductive film will push the membrane to produce audio.

One problem with electrostatic loudspeakers of this type is obtaining sufficient displacement of the membrane. WO 2012/156753 discloses an electrostatic transducer comprising an electrically conductive first layer having through apertures, a flexible insulating second layer over the first layer, and a flexible electrically conductive third layer disposed over the second layer. Spaces are provided between the first and second layers or between the second and third layers. Spaces between the first and second layers allows greater freedom of movement of the second and third layers, allowing greater displacement of the second and third layers. Spaces between the second and third layers were also found to improve acoustic performance.

However, there remains a need for further improvement in the acoustic performance of electrostatic transducers of this type.

SUMMARY

The present invention relates to an electrostatic transducer (100) which comprises an electrically conductive first member (102) having an array of through apertures (112) and one or more further members (104, 106). The one or more further members (104, 106) include a flexible electrically conductive second member (106) arranged in use to be displaced from an equilibrium position towards the first member (102) by an electrostatic force in response to an electrical potential applied to one or both of the first member (102) and the second member (106). At least one (104) of the one or more further members is resiliently deformable and is arranged in use to exert a resilient biasing force biasing said second member (106) back towards said equilibrium position when displaced therefrom by said electrical potential.

DESCRIPTION OF THE DRAWINGS

Certain embodiments will now be described, by way of example only, with reference to the accompanying drawings in which.

Figure 1:
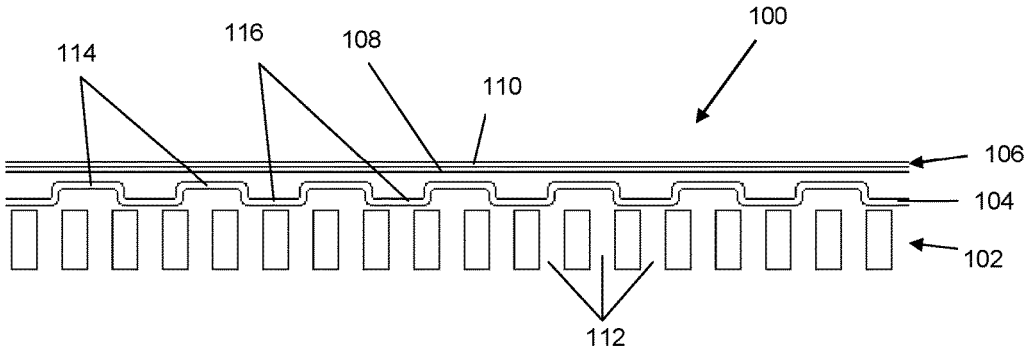
FIG. 1 is a diagrammatic section through a transducer in accordance with one embodiment of the invention, wherein the transducer comprises an embossed flexible electrically insulating member.

When viewed from a first aspect, the invention provides an electrostatic transducer comprising: an electrically conductive first member having an array of through apertures; and one or more further members, wherein the one or more further members include a flexible electrically conductive second member arranged in use to be displaced from an equilibrium position towards the first member by an electrostatic force in response to an electrical potential applied to one or both of the first member and the second member and wherein at least one of the one or more further members is resiliently deformable and is arranged in use to exert a resilient biasing force biasing said second member back towards said equilibrium position when displaced therefrom by said electrical potential.

The resiliently deformable member thus stores elastic potential energy as it is deformed as the second member is displaced towards the first member. When the electrical potential is decreased, the forces creating this potential energy decrease, and the resiliently deformable member reverts partially or fully back to its un-deformed state, exerting a corresponding reverse force on the second member. The resiliently deformable member thus acts as a spring, to restore the second member to its equilibrium position more quickly. This has been found to improve the acoustic performance of the transducer. For example such arrangements may increase the usable frequency range and improve the overall quality of the sound generated by a transducer. This is illustrated by a 6 dB increase in the sound pressure level between 200 Hz and 5 kHz having been observed in some embodiments.

The invention as outlined above could be applied to so-called push-pull transducers in which electrically conductive members are provided on either side of the flexible electrically conductive second member to move it in both directions. However in preferred embodiments the transducer is arranged in use to apply an electrical potential which gives rise only to an attractive electrostatic force between the electrically conductive first member and the flexible electrically conductive second member. In such an arrangement only a single electrically conductive first member is necessary. The return force mentioned hereinabove allows good acoustic performance to be achieved nonetheless.

The resiliently deformable member could be arranged such that it is placed in tension or compression by said displacement of the second member.

In some embodiments the flexible electrically conductive second member is also the resiliently deformable member which provides the biasing force. The electrostatic transducer may therefore have only two members: the electrically conductive first member and the flexible and resilient electrically conductive second member just described.

In some embodiments, the electrostatic transducer comprises at least three members: the electrically conductive first member, the flexible electrically conductive second member and a flexible electrically insulating third member between the first and second members. In these embodiments, one or both of the second and third members is resiliently deformable and provides the prescribed biasing force. Where the third member is resiliently deformable it will be resiliently compressible. When an electrical potential is applied to the first and second members, they are pulled together. The resilient third member is compressed by the electric forces pulling the first and second members together and it applies the biasing force as a restoring force reacting to such compression.

In some embodiments the flexible electrically conductive second member may extend over the first member, and a resiliently deformable third member may extend over the second member. The third member may be bonded at least in part to the second member, although this is not essential. The second and third members of such embodiments thus form a composite structure. It is believed that the presence of the resiliently deformable third member causes the composite structure comprising the second and third members to deform more resiliently under the electrical potential. This property of the composite layer results in a spring force that moves the deformed composite structure more quickly towards the equilibrium position when the electrical potential is decreased, thus improving the acoustic performance of the transducer.

In some embodiments, the resiliently deformable member is resiliently deformable by virtue of having a non-planar profile (e.g. a complex 3D profile). The profile may comprise a plurality of locally protruding portions. The protruding portions may be continuous (with the profile exhibiting a smoothly changing gradient e.g. in the case of dimples) or may be discrete, e.g. step-like protrusions. The protruding portions may have any suitable shape, e.g. they are circular. The protruding portions may have any suitable arrangement or pattern, for example the pattern may be regular or random. In some embodiments, the protruding portions have a square lattice arrangement. In some embodiments, the raised regions may have a hexagonal close-packed arrangement.

Such a non-planar profile may be achieved by any suitable means, e.g. moulding but in some embodiments the non-planar profile is achieved by embossing the member. Any suitable embossing techniques may be used, and the preferred technique for embossing may depend upon the materials from which the members are made. In some preferred embodiments, the resiliently deformable member is embossed using hot embossing.

Where provided, the protruding portions of the resiliently deformable member may have any suitable shape and dimension. In some embodiments, the protruding portions have a maximum dimension parallel to the median plane of the resiliently deformable member of between 1 mm and 20 mm, such as between 5 mm and 10 mm.

In general the shape, dimension and arrangement of the protruding portions may be selected to achieve an optimal spring constant for the resiliently deformable member.

The optimum effective thickness of the resiliently deformable member (i.e. where the member is profiled, the depth of the 3D profile) may depend on the desired deformability and also on the desired proximity of the first member to the second member. For example, where a profiled third member is provided between the first and second members, if the effective thickness of the third member is too large, this will reduce the electrostatic force between the first and second members, which may adversely affect the performance of the transducer. Conversely, if the effective thickness is too small, this may reduce the restoring spring force that the resiliently deformable member is able to provide, which may reduce the potential benefit that is achieved. In some embodiments the effective thickness of the resiliently deformable member is between 0.25 mm and 10 mm.

The profiling may incorporate a range of shapes, dimensions and/or arrangements/patterns in a single member. For example, a different pattern may be provided towards the edge of the member compared with the middle. This variation may also help to provide an optimal spring constant or variation of spring constant across the member.

Where the transducer comprises a flexible electrically insulating third member between the first and second members, and where both the second and third members are profiled so as to be resiliently deformable, the respective profile patterns may be arranged so that the positions of protruding portions of the second member do not overlap with the protruding portions of the third member. This may facilitate compression of the third member by the first and second members. Similarly, the compression of the second member may be facilitated.

In some embodiments where both the second and third members are profiled, the profile pattern of the second and third members are mutually inverse—i.e. where the third member protrudes, the second member does not, and vice versa. Thus the contact between the non-protruding portions of the second member and the protruding portions of the third member is maximised for that particular pattern, so enhancing the compression of the second and third members.

Except where the second and third members are bonded to form a composite structure and discussed above, the members may be separate, i.e. free to move independently of each other. In such embodiments therefore, the members may be joined only at the edges of the transducer. In other embodiments, the members may be bonded together, either in part or across their entire surfaces. For example, the members may be bonded at bonding lines spaced across the members. There may be bonding provided between the first and second members. Where the transducer comprises a third member between the first and second members, there may be bonding provided between the first and third members, the third and second members, or between both the first and third members and the third and second members. The bonds between the members may have negligible thickness or may serve as spacers separating the members.

The first, second and/or third members may comprise a substantially planar sheet.

The electrically conductive first member may be made of any suitable material or combination of materials. The electrically conductive first member is preferably rigid, but may be semi-rigid or flexible. For example, the first member may be a composite layer comprising a polymer sheet having a conductive layer applied thereon by metallization, e.g. by vapour deposition. The conductive layer may comprise aluminium. Alternatively, the first member may comprise a metal sheet. In some embodiments, the metal sheet is aluminium.

The apertures in the first member may be circular. The apertures may have a maximum dimension parallel to the median plane of the first member of between 0.5 mm and 10 mm, e.g. about 1.5 mm. The spacing between the apertures may be between 0.5 mm and 2 mm, e.g. about 1 mm. The term "spacing" as used herein with reference to aperture spacing has the meaning of the distance between the closest edges of adjacent apertures (i.e. the thickness of the material between the apertures), rather than, for example, the distance between the centres of adjacent apertures.

Where provided, the flexible insulating third member may be made of any suitable material or combination of materials, but preferably it is made from a polymer, e.g. Mylar.

The flexible electrically conductive second member may be made of any suitable material or combination of materials, but preferably it is made from a metallised polymer sheet. For example, the second member may be made from a Mylar polymer sheet having a layer of aluminium deposited thereon by metallization.

To maximise the achievable displacement of the second member under the influence of the electric forces, it is desirable that the second and third members are thin to reduce the separation between the first and second members to which the electrical potential is applied. This applies particularly if one of the second or third members is not profiled.

Where the second member is not provided with a 3D profile, it may be less than 50 μm thick, e.g. less than 30 μm thick, e.g. about 10 μm thick. Where the third member is not provided with a 3D profile, it may be less than 50 μm thick, e.g. less than 30 μm thick, e.g. about 10 μm thick.

For a profiled member, there will be an increase in the effective thickness of the member due to the profile, which may be optimised as discussed above. The thickness of a material from which the member is made may affect the spring constant of the member. The thickness of the material may therefore be chosen to produce a desired spring constant.

Where the second member is provided with a 3D profile, it may be made from a sheet that is less than 50 μm thick, e.g. made from a sheet that is less than 30 μm thick, e.g. made from a sheet that is about 10 μm thick. Where the third member is provided with a 3D profile, it may be made from a sheet that is less than 50 μm thick, e.g. made from a sheet that is less than 30 μm thick, e.g. made from a sheet that is about 10 μm thick.

The thickness of each member may be constant, or may vary across the transducer.

FIG. 1 shows a transducer 100 comprising a first member, or backplane, 102 with a thickness of 3 mm. The first member 102 is made from an insulating polymer sheet which has been provided with a conductive layer (not shown) on its upper surface via a metallization process. Extending over the first member 102 is a resiliently deformable electrically insulating member 104, which is made from a polymer sheet of 10 μm thickness. Extending over the deformable insulating member 104 is a composite second member 106 which is flexible and electrically conductive. The composite second member 106 comprises a flexible insulating polymer sheet 108 having a conductive layer 110 overlaid thereon by metallization. The conductive layer 110 is on the surface of the polymer sheet 108 that faces away from the insulating member 104. The second member 106 has a thickness of 10 μm although in other embodiments other thicknesses may be used.

The first member 102 is provided with an array of through apertures 112. The apertures 112 are circular with a diameter of 1 mm, and with an inter-aperture spacing of 1 mm. The through apertures 112 are positioned in a regular square lattice arrangement.

Figure 2:
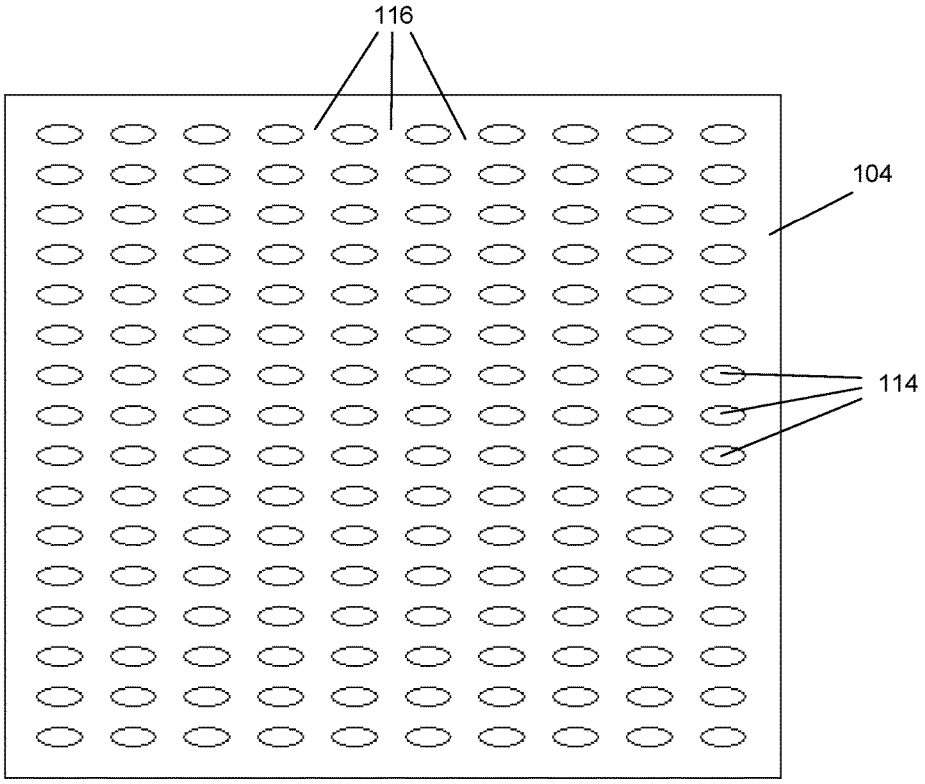
FIG. 2 is a plan view of the embossed insulating member of the transducer of FIG. 1.

The resiliently deformable insulating member 104 is embossed with a pattern so as to provide protruding regions 114 in between lower regions 116. In the present embodiment, the protruding regions 114 are oval regions having a length of 2.5 mm and a spacing of 2 mm. However, in other embodiments other dimensions and spacings of the protruding regions 114 may be used. In the present embodiment, the protruding regions 114 are arranged in a square lattice arrangement as shown in FIG. 2. The embossing of the insulating member 104 provides a layer having effective thickness of 0.5 mm. The 3D profile achieved by the embossing and the flexibility of the polymer from which the insulating member 104 is made provides the insulating member 104 with the property of being resiliently compressible. This means that when the insulating member 104 is compressed between the first member 102 and the second member 106, the insulating member 104 resiliently deforms so as to allow the other two members 102, 106 to move closer to one another, but also provides a resilient bias force tending to push the members 102, 106 apart.

When the transducer is operated, an electrical potential is applied to the first member 102 and the conductive layer 110 of the second member 106. The electrical potential consists of a DC potential (250V) added to an AC drive signal (+1-200V), the latter corresponding to the desired sound. This results in a potential that can vary between 50V and 450V, depending on the desired sound waveform. The electrical potential causes an attractive electrostatic force between the first member 102 and the second member 106 that depends on the strength of the potential. The second member 106 moves towards the first member 102 as a result of the force, moving the air around it. An acoustic response to the electrical signal is thereby produced.

The role of the resiliently compressible insulating member 104 is to provide a spring bias force when the first member and the second member 106 move towards each other under the influence of the electrostatic potential. When the electrostatic potential decreases, the bias force provided by the resiliently compressible member 104 prevails and pushes the first and composite members 102, 106 apart, back to their equilibrium position. The resiliently compressible member 104 thus acts as a return spring, restoring the composite member 106 more quickly towards its equilibrium position following the decrease of the electric potential, thereby improving the acoustic performance of the transducer.

FIG. 2 shows a plan view of the embossed insulating member 104 of the embodiment of FIG. 1. The embossed insulating member 104 is provided with an array of protruding regions 114 between non-protruding regions 116. The protruding regions 114 have an oval shape having a length of 2.5 mm. The protruding oval regions 114 are arranged in a square lattice arrangement, such that the spacing between protruding regions 114 is approximately the same length scale as the length of the oval regions. In other embodiments, the length scales may be different, similar, or exactly the same. Depending on the pattern the 'protruding' regions could protrude towards or away from the first member 102.

In other embodiments, other shapes dimensions and arrangements of the protruding regions are possible. For example, the protruding regions may be circular. In other embodiments, the protruding regions may have, for example, dimension 1 mm and spacing 1 mm, or dimension 4 mm and spacing 4 mm, or dimension 4 mm and spacing 1 mm. In other example embodiments, the protruding regions may be arranged in different patterns, e.g. a hexagonal close-packed lattice arrangement, or the raised regions could be arranged randomly. The pattern or arrangement of the raised regions may vary across the surface of the embossed insulating member 104.

Figure 3:
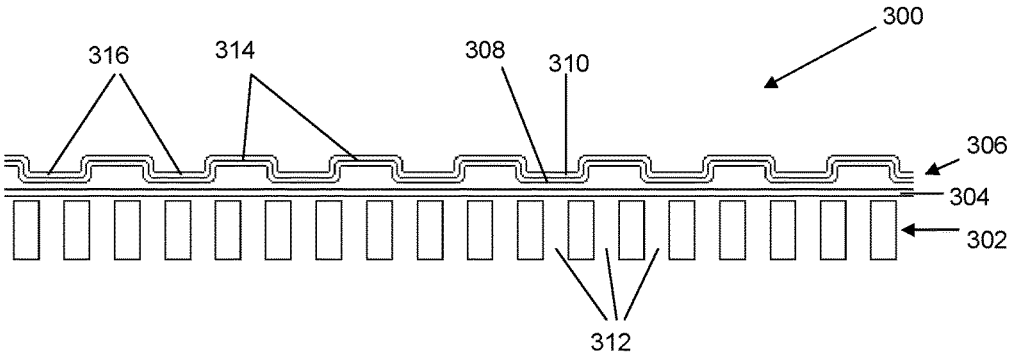
FIG. 3 is a diagrammatic section through a transducer in accordance with another embodiment of the present invention, wherein the transducer comprises a flexible insulating member and wherein the flexible electrically conductive member is embossed.

FIG. 3 shows an alternative embodiment of a transducer 300. In this embodiment, the first member 302 is 5 mm thick, although other thickness are possible. The first member 302 is made from a polymer sheet having a conductive layer applied to one of its surfaces by metallisation. In this embodiment the metallization is an aluminium layer, although other metals may be used for the metallization or a solid metallic sheet could be used. Extending over the first member 302, on the surface adjacent the metallisation layer, is a flexible electrically insulating sheet member 304. The insulating member 304 is a made from a sheet of the polymer Mylar, although other materials or other polymers could be used. The polymer sheet has a thickness of 10 μm, although other thicknesses are possible.

Extending over on the insulating sheet 302 is a flexible electrically conductive composite second member 306. The composite second member 306 comprises a flexible polymer sheet 308, with an aluminium metallization layer 310 overlaid thereon. In this embodiment, the second member 306 has been embossed so as to provide protruding regions 314 and non-protruding regions 316. The embossing of the composite member 306 gives it an effective thickness of 0.5 mm. The three dimensional structure of the composite member 306 provides it with the property of being resiliently deformable.

During the operation of the transducer, an electrical potential is supplied to the first member 302 and to the metallization layer 310 of the second member 306, such that these members are attracted towards one another. As the second member 306 moves towards the first member 302, it is separated from the first member 302 by the insulating member 304. Once the second member 306 contacts the insulating member 304, the reaction force of the insulating member 304 prevents the non-protruding regions 316 of the insulating member 304 from moving any closer to the first member 302. However, the protruding regions 314 can continue to move towards the first member 302 under the electrostatic force due to the potential. The second member 306 is thereby compressed due to the attractive force between itself and the first member 302. When the electrostatic potential is decreased, the resiliently compressible second member 306 returns to its un-deformed state, springing away from the insulating member 304. The second member 306 is thereby moved towards its equilibrium position from first member 302 more quickly due to the spring force, thereby providing an improved acoustic performance of the transducer 300.

Figure 4:
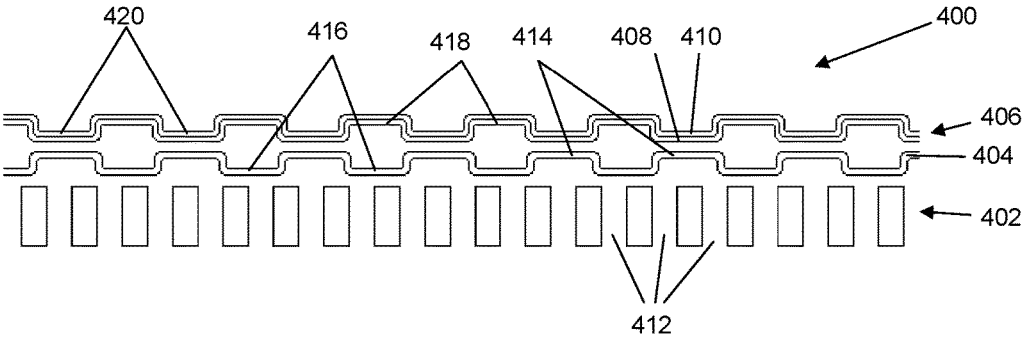
FIG. 4 is a diagrammatic section through a transducer in accordance with a further embodiment of the present invention, wherein the transducer comprises an embossed flexible insulating member and wherein the flexible electrically conductive member is embossed.

FIG. 4 shows a further embodiment in accordance with the present invention. In this embodiment, the transducer 400 comprises a first member 402 that is electrically conductive. This member is 6 mm thick and is e.g. made from a polymer sheet with a metallization layer thereon. The first member 402 is provided with an array of through apertures 412 arranged in a hexagonal close-packed lattice arrangement. The apertures 412 have dimension of 1 mm and spacing of 1 mm. Over the first member 402, adjacent the metallization layer, is provided a flexible insulating member 404. Insulating member 404 is embossed so as provide protruding regions 414 in between non-protruding regions 416. The protruding regions have a circular shape, and a diameter of 3 mm and spacing of 3 mm. The protruding regions 414 are arranged in a square lattice arrangement. The polymer layer from which the embossed second layer 404 is made is 10 μm thick. The embossing of the layer 404 gives the it an effective thickness of 0.8 mm.

Extending over the second layer 404 is a flexible electrically conductive composite member second 406, which comprises a polymer sheet 408 having a metallisation layer 410 applied to one surface thereof. The thickness of the polymer sheet 408 plus metallization layer 410 is 10 μm. The second member 406 is also embossed and has an effective thickness of 0.8 mm. The embossing of the second member 406 provides protruding regions 418 in between non-protruding regions 420. The protruding regions 418 also have a circular shape. The protruding regions 418 have a diameter of 3 mm. The spacing 420 between the protruding regions 418 is the same as the spacing 416 between protruding regions 414 of the insulating member 404, i.e. 3 mm. This makes it possible to align the embossed members 404, 406 such that the protruding regions 414 of the insulating member 404 coincide with the non-protruding regions 420 of the second member 406, and the protruding regions 418 of the second member 406 coincide with the non-protruding regions 416 of the insulating member 404. This arrangement is described further hereinbelow with reference to FIG. 5.

Figure 5:
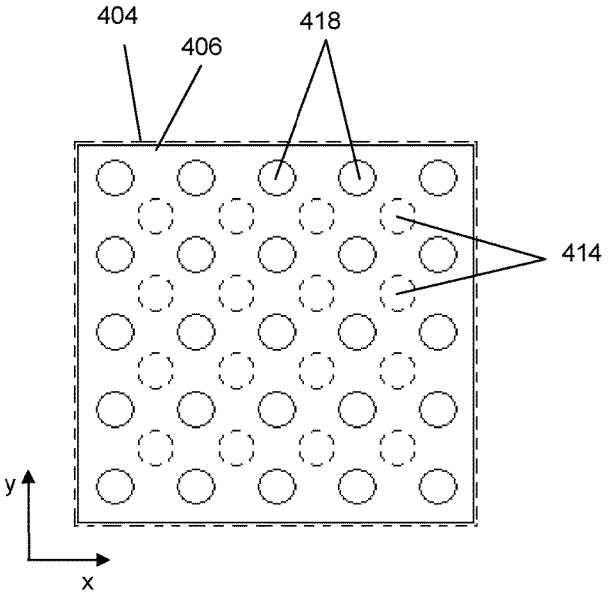
FIG. 5 is a diagrammatic plan view of part of the transducer of FIG. 4, showing the embossed flexible electrically conductive member overlaid on the embossed insulating member.

FIG. 5 shows a diagrammatic plan view of the insulating member 404 and the composite member 406 of the embodiment shown in FIG. 4. The insulating member 404 is represented by dotted lines, while the second member 406 is represented by solid lines. The protruding regions 414 and 418 of both members 404, 406 are arranged in a square lattice arrangement. However, the protruding regions 418 of the second member 406 are displaced by half a lattice spacing in the directions x and y as shown in FIG. 5, such that the protruding region 414 is positioned in the centre of the non-protruding region 420 between each group of four protruding regions 414 forming a square. This enables the protruding regions 414 to be compressed by the non-protruding regions 420, so that the insulating member 404 is compressed when the second member 406 moves towards the first member 402. The protruding regions 414 are thus also able to provide a reaction force against the non-protruding regions 420 as the second member 406 is drawn towards the first member 402. This reaction force facilitates the compression of the second member 406 as described above with reference to FIG. 3.

In variations on the embodiment of FIG. 4, the embossing of one of the embossed members 404, 406 may be inverted, such that one of these members is provided with circular protruding regions while the other of the members is provided with circular regions protruding in the opposite direction. In such variations, the respective circular protruding regions could be arranged to coincide exactly so that the two members nest, thereby maximising the contact area between them.

Under operation of the transducer of FIGS. 4 and 5, an electrical potential is applied to the first member 402 and the conductive metallization layer 410 of the second member 406 such that the members 402, 406 are attracted towards one another. Under the electrical potential, the first member 402 and the second member 406 move towards one another. The embossed insulating member 404 which is between the first member 402 and the second member 406 is thus compressed. By the same mechanism as described with regard to FIG. 3, the embossed second member 406 is also compressed due to the attractive force between itself and first member 402, and the reaction force of the insulating member 404.

When the electrical potential between the first member 402 and composite member 406 is decreased, by the same mechanisms as described above with reference to FIGS. 2 and 3, the spring forces of the insulating member 404 and the second member 406 push the composite member 406 more quickly towards its equilibrium position. The acoustic performance of the transducer is thereby improved.

Figure 6:
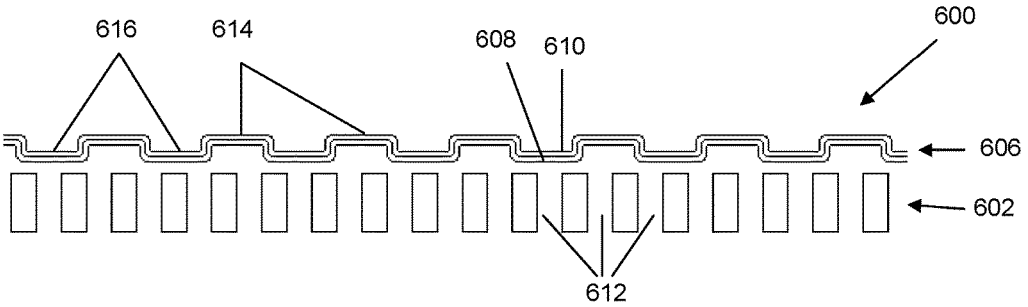
FIG. 6 is a diagrammatic section through a transducer in accordance with a further embodiment of the invention, wherein the transducer consists of two members and the flexible electrically conductive member is embossed.

FIG. 6 shows an embodiment of a transducer 600 comprising a first member 602 and a composite second member 606. In this embodiment, there is no additional flexible insulating member between the first member 602 and the second member 606. The first member 602 is an electrically conductive member having through apertures 612. First member 602 is made from a polymer sheet with a metallised layer on one surface thereof, and has a thickness of 1 mm. As in other embodiments it could equally be of metal. The second member 604 extends over the first member 602 on the side adjacent the metallization. The second member 606 is flexible and electrically conductive, and comprises a flexible polymer sheet 608 with a metallisation layer 610 on the surface facing away from the first member 602. The second member 606 is embossed so that it is resiliently compressible. The embossing provides protruding regions 614 between relatively non-protruding regions 616.

Under operation of the transducer, an electrical potential is applied to the first member 602 and to the metallization layer 610 of the second member 606. This electrical potential causes the first member 602 and the composite member 606 to be attracted towards one another. The polymer sheet on which the metallisation 610 is provided prevents contact between the conductive metallization layer 610 and the first member 602, thereby preventing charge flow between them. Under the attraction of the electrostatic potential, the composite second 606 is compressed by the same mechanism as described with respect to the composite 306 of the embodiment of FIG. 3. The second member 606 thus provides a spring force to restore itself more quickly towards its equilibrium position upon decrease of the electrostatic potential, thereby improving the acoustic performance of the transducer 600.

Figure 7:
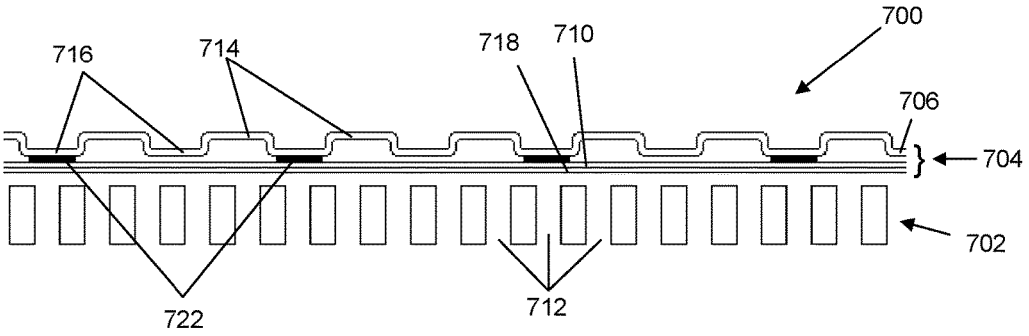
FIG. 7 shows is a diagrammatic section through a transducer in accordance with a further embodiment of the invention, wherein the transducer comprises an embossed flexible insulating member overlaid on and bonded to the flexible electrically conductive member.

FIG. 7 shows an embodiment of a transducer 700 comprising a first member 702 and a composite structure 704. The first member 702 is an electrically conductive aluminium sheet having through apertures 712. The first member is 4 mm thick and the apertures are circular with 1 mm diameter and 1.5 mm spacing. The composite structure 704 extends over the first member 702 and is flexible and electrically conductive. It comprises a flexible polymer sheet 708 with a metallisation layer 710 on the surface facing away from the first member 702, with an embossed flexible insulating member 706 bonded to the metallization layer 710.

Under operation of the transducer, an electrical potential is applied to the first member 702 and to the metallization layer 710 of the composite structure 704. This electrical potential causes the first member 702 and the composite structure 704 to be attracted towards one another. The composite structure 704 is displaced towards the first member 702. Due to the presence of the embossed member 706 in the composite structure 704, the composite structure 704 deforms resiliently, and springs back from its deformed shape towards its un-deformed shape when the electrostatic potential is decreased. The composite structure 704 thus provides a spring force to restore itself more quickly towards its equilibrium displacement from the first member 702 upon decrease of the electrostatic potential, thereby improving the acoustic performance of the transducer 700.

The invention claimed is:

1. An electrostatic transducer comprising:

an electrically conductive first member having an array of through apertures;

a flexible electrically conductive second member arranged in use to be displaced from an equilibrium position towards the first member by an electrostatic force in response to an electrical potential applied to one or both of the first member and the second member; and a flexible electrically insulating third member between the electrically conductive first member and the flexible electrically conductive second member;

wherein the flexible electrically conductive second member comprises a substantially planar sheet;

wherein the flexible electrically insulating third member is resiliently compressible by virtue of being embossed so that it has a non-planar profile; and wherein the flexible electrically insulating third member is arranged in use to exert a resilient biasing force biasing said second member back towards said equilibrium position when displaced therefrom by said electrical potential.

2. The electrostatic transducer of claim 1, wherein the transducer is arranged in use to apply an electrical potential which gives rise only to an attractive electrostatic force between the electrically conductive first member and the flexible electrically conductive second member.

3. The electrostatic transducer of claim 1, wherein the non-planar profile comprises a plurality of locally protruding portions.

4. The electrostatic transducer of claim 3, wherein the protruding portions have a maximum dimension parallel to the median plane of the flexible electrically insulating third member of between 1 mm and 20 mm.

5. The electrostatic transducer of claim 1, wherein the effective thickness of the flexible electrically insulating third member is between 0.25 mm and 10 mm.

6. The electrostatic transducer of claim 1, wherein the first, second and third members are joined only at the edges of the transducer.

7. The electrostatic transducer of claim 1, further comprising bonding between the first and second members; between the first member and/or the third member; and/or between the second member and/or the third member.

8. The electrostatic transducer of claim 1, wherein the apertures in the first member have a maximum dimension parallel to the median plane of the first member of between 0.5 mm and 10 mm.

9. The electrostatic transducer of claim 1, wherein the spacing between the apertures in the first member is between 0.5 mm and 2 mm.

10. The electrostatic transducer of claim 1, wherein the electrically conductive first member is a composite layer comprising a polymer sheet having a conductive layer applied thereon by metallization.

11. The electrostatic transducer of claim 1, wherein the flexible electrically conductive second member is made from a metallised polymer sheet.

12. The electrostatic transducer of claim 6, further comprising at least one of bonding between the first member and the third member; or bonding between the second member and the third member.

* * * * *